US005846176A

United States Patent [19]

Zieger et al.

[11] Patent Number: 5,846,176

[45] Date of Patent: Dec. 8, 1998

[54] ROLLER TOOL FOR CONCRETE FINISHING

[76] Inventors: Robert V. Zieger; Michele S. Zieger, both of 49798 W. Esch Trail, Mariciopa, Ariz. 85239-4856

[21] Appl. No.: 833,692

[22] Filed: Apr. 8, 1997

[51] Int. Cl.[6] ..... B05C 17/02

[52] U.S. Cl. ..... 492/13; 492/19

[58] Field of Search ..... 15/230.11, 248.2; 492/13, 19

[56] References Cited

U.S. PATENT DOCUMENTS

| | | | |
|---|---|---|---|
| 1,302,275 | 4/1919 | Ashmore et al. . | |
| 1,551,260 | 8/1925 | Michaels | 492/13 |
| 3,386,124 | 6/1968 | Feine | 492/13 |
| 3,389,466 | 6/1968 | Parris | 492/13 |
| 3,910,738 | 10/1975 | Chandler et al. . | |
| 4,743,140 | 5/1988 | Maletic . | |
| 5,401,231 | 3/1995 | Herbert . | |
| 5,410,773 | 5/1995 | Forkner | 15/230.11 |
| 5,509,165 | 4/1996 | Zigelboim et al. | 15/230.11 |
| 5,533,223 | 7/1996 | Ho | 492/13 |
| 5,611,100 | 3/1997 | Zigelboim et al. | 15/230.11 |

*Primary Examiner*—Irene Cuda

*Attorney, Agent, or Firm*—Richard C. Litman

[57] ABSTRACT

A concrete-finishing roller tool produces a desired texture using a simple operation, independent of a remote power source. A hollow cylindrical roller body incorporates randomly spaced protrusions or nubs on its surface. The protrusions have a substantially crystalline structure to emulate grains of salt for use in texturing freshly-poured concrete. A U-shaped frame rotatably engages the roller body, with a female socket member to receive a separate pole handle for remote manipulation thereof. Evenly-distributed concrete filler ensures that the roller body exerts a constant pressure to produce an even texturing pattern on a concrete surface. Alternatively, the roller body comprises a container member and a removable cap member that threadably engage each other, allowing a user to deposit a desired amount of sand therein to adjust the pressure that the roller body exerts. The concrete-finishing roller tool also eliminates concrete debris accumulation with a roller irrigation system to help prevent the drying of concrete debris on the roller body and a broom attachment that brushes off concrete debris that accumulates on the roller body during use. An alternative embodiment is a one-sided axle support system for the roller body that affords its use on the side edges of concrete surfaces, which are not accessible by other embodiments of the invention, thereby guaranteeing a complete concrete pattern finish.

12 Claims, 4 Drawing Sheets

ROLLER TOOL FOR CONCRETE FINISHING

BACKGROUND OF THE INVENTION

1. Field of the Invention

The present invention relates to equipment for concrete finishing, and more specifically to a hand-held, roller tool for texturing freshly-poured concrete.

2. Description of Related Art

Texturing devices for freshly-poured concrete have diverse applications, where the structure and the operation of the device depend on its intended use. U.S. Pat. No. 4,743,140, for example, discloses a texturing device used in the paving of roadways and bridges, which is incorporated into the carriage finisher for pouring and striking concrete during construction.

Another type of texturing device features a roller-type construction, having a cylindrical member that rotates about a fixed axis, whereby the surface of the cylindrical member contacts the concrete and a handle perpendicular to the member urges rotation thereof. The roller for finishing and smoothing cement and concrete pavements disclosed in U.S. Pat. No. 1,302,275 is designed for use between the rails or tracks of railways.

Other roller devices for texturing involve the creation of an aesthetic pattern on a flat surface. U.S. Pat. No. 5,401,231 discloses a texturing roller for applying plaster to a flat surface, such as a wall or ceiling, in a texturing pattern. The roller of '231 includes a roller cylinder having random holes and multiple leather discs secured therein by rivets, and mounts onto a conventional painting roller frame.

Moreover, the concrete finishing roller of U.S. Pat. No. 3,910,738 has an embossed design on its outer surface, and is rotatably mounted on an axle. A handle connects to the axle so that the roller may be pushed across an wet concrete surface, ultimately facilitating the impression of the roller design into the concrete. The depth of the impression made in the concrete surface may be varied by the addition or removal of weights on the handle and by vibrating the roller in a vertical plane as its moves across the concrete surface.

The vibrating means of the roller of '738 comprise an internal electric motor system, and requires an electrical connector, such as an extension cord, to convey current thereto. Concrete work is exacting, and often involves conditions not conducive to using a device having a loose electrical cord, including mixing and pouring wet concrete. The complexity of operating and expense of manufacturing the roller of '738 also compromise its practicality.

The design of the roller of '738 also lacks any features that specifically involve the quick-drying nature of concrete. For example, concrete workers must keep the concrete wet while texturing it, until the job is complete, so that mistakes in the concrete can be "troweled out." The roller of '738 does not include means for maintaining the wetness of the concrete, requiring an extra workman to do so with a hose. Furthermore, the roller of '738 lacks means for clearing the accumulated concrete debris therefrom. A build-up of concrete debris could result in the creation of an uneven texturing pattern on the concrete.

A well-known method of texturing freshly-poured concrete involves scattering salt crystals onto the surface of freshly-poured concrete and using a hand-held trowel to smooth the surface. The salt crystals can then be power-washed from the dried concrete surface, whereby the surface texture remains intact. While it produces the desired concrete surface texture, the salt-sprinkling method is problematic, requiring critical timing, generating unattractive trowel marks, necessitating exacting manual labor and creating a mess that must be cleaned up.

In light of the shortcomings of the inventions, patents and methods described above, there is a need for a concrete-finishing tool that is easy to use and produces a desired texture. There is also a need for a concrete-finishing roller tool of simple operation and independent of a remote power source. In addition, there is a need for a concrete-finishing roller tool that maintains the wetness necessary for concrete work, and eliminates the concrete debris that accumulates on the roller.

None of the above inventions and patents, taken either singly or in combination, is seen to describe the instant invention as claimed.

SUMMARY OF THE INVENTION

The concrete-finishing roller tool of the present invention aims to produce a desired texture using a simple operation, independent of a remote power source. A hollow cylindrical roller body incorporates randomly spaced protrusions or nubs on its surface. The protrusions have a substantially crystalline structure to emulate grains of salt for use in texturing freshly-poured concrete. A substantially U-shaped frame terminates in two end flanges that rotatably engage the two ends of the roller body. A female socket member integrally connects to the U-shaped frame and receives a separate pole handle to facilitate the remote manipulation of the roller body.

The roller body can be filled with concrete, which is evenly distributed along its length to ensure that it exerts a constant pressure for an even texturing pattern on a concrete surface. Alternatively, the roller body comprises a container member and a removable cap member that threadably engage each other to facilitate opening and closure of the roller body that allows a user to deposit a desired amount of sand therein, commensurate with the desired pressure to be exerted by the roller body, to adjust the pressure that the roller body exerts.

The concrete-finishing roller tool also eliminates concrete debris accumulation on the roller. Specifically, a roller irrigation system helps to prevent the accumulation of concrete debris on the roller body. A water bottle secured to the handle engages a hose which in turn engages an irrigation member that terminates in a plurality of conduits. Water stored in the bottle flows through the hose and the conduits to continuously moisten the roller body, and thereby prevent the accumulation of concrete debris thereon. Water flow from the bottle to the conduits can be either gravity-controlled or hand-controlled with a trigger mechanism.

Further means for keeping roller body clear from concrete debris comprise a broom attachment that removably secures onto the back side of the U-shaped frame. The bristles of the broom contact the roller body surface, so that rotational motion thereof facilitates the brushing off of concrete debris that accumulates thereon.

Another alternative embodiment of the present invention comprises a one-sided axle support system for the roller body. The axle support system comprises three integrally connected, substantially cylindrical members. One of the members engages the female socket member, and extends perpendicular to it. Another of the members, oriented parallel to the first, insertably engages the roller body, and is removably secured therein to facilitate rotational movement of the roller body. A third cylindrical member is perpendicular to the first and second, serving as a connection between them. This embodiment of the invention affords its use on the side edges of concrete surfaces, which are not accessible by other embodiments of the invention, thereby guaranteeing a complete concrete pattern finish.

Accordingly, it is a principal object of the invention to provide an easy to use concrete-finishing tool that produces a desired texture.

It is another object of the invention to provide a concrete-finishing roller tool of simple operation that is independent of a remote power source.

It is a further object of the invention to prevent the accumulation of concrete debris during use.

Still another object of the invention is to emulate the salt-sprinkling texturing method and achieve the resulting pattern in freshly-poured concrete without incurring the unattractive trowel marks, exacting manual labor and mess associated therewith.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
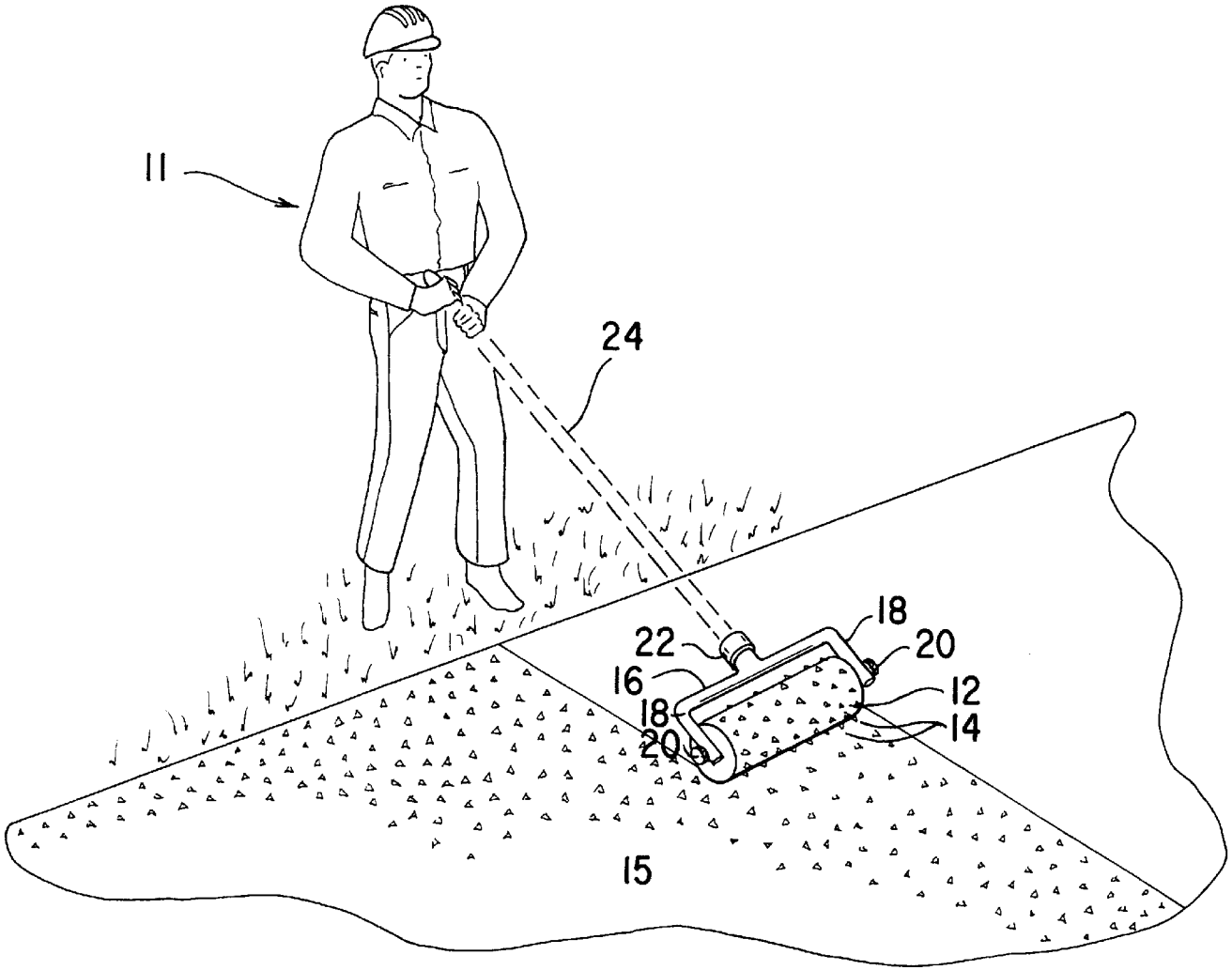
FIG. 1 is an environmental perspective view of the preferred embodiment of the rolling tool for concrete finishing of the present invention.

The present invention, referenced by 10, is shown in FIG. 1, as employed by a concrete worker 11. A hollow cylindrical roller body 12 incorporates randomly spaced protrusions or nubs 14 on its surface, which in turn contact a concrete surface 15. A substantially U-shaped frame 16 terminates in two end flanges 18 that rotatably engage the two ends of roller body 12. Bolts 20 insertably engage apertures defined by each of flanges 18 and each of the circular end surfaces of roller body 12, at the substantial centers thereof, to removably secure roller body 12 to each of end flanges 18. A female socket member 22 integrally connects to U-shaped frame 16 at its substantial center, on the side opposite to roller body 12. A separate pole handle 24 insertably engages socket member 22 to facilitate the remote manipulation of roller body 12.

Protrusions 14 are formed from the material comprising roller body 12, thereby integrated into and continuous with the actual surface thereof. Alternatively, protrusions 14 can be secured onto the surface of roller body 12 by affixing them to the surface itself, by molding a wrap-around metal sheet that incorporates protrusions 14, for affixing to roller body 12, with a rust-proof coating, or by molding a wrap-around rubber or plastic sheet that similarly incorporates protrusions 14, for affixing to roller body 12. Protrusions 14 are randomly formed in, or placed on the surface of roller body 12, or on the sheet of material to be affixed to roller body 12, and have a substantially crystalline structure to emulate grains of salt for use in texturing freshly-poured concrete.

In the preferred embodiment of the invention, roller body 12 is filled with concrete. The concrete filler is evenly distributed along the length of roller body 12 to ensure that it exerts a constant pressure for an even texturing pattern on concrete surface 15.

Figure 2:
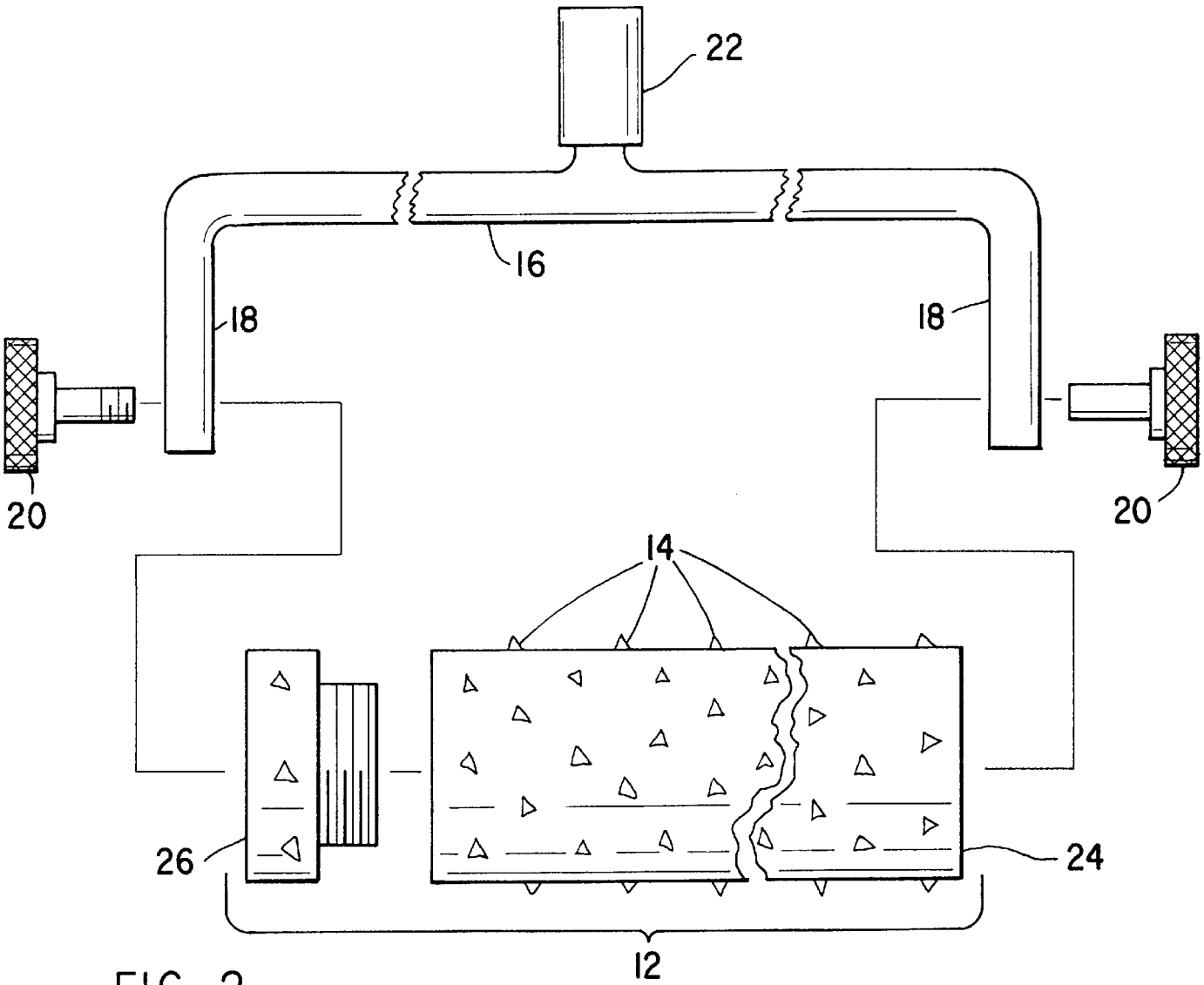
FIG. 2 is an exploded elevational view of an alternative embodiment of the rolling tool for concrete finishing of the present invention.

Now referring to FIG. 2, an alternative embodiment of the present invention allows a user to adjust the pressure exerted by roller body 12 during use. In this embodiment, roller body 12 comprises a container member 24 and a removable cap member 26. Container member 24 and cap member 26 threadably engage each other to facilitate opening and closure of roller body 12. To adjust the pressure exerted by roller body 12, a user disengages bolts 20 from the apertures defined by the circular ends of roller body 12 and by flanges 18, so as to remove roller body 12 from U-shaped frame 16. Removal of cap member 26 from container member 24 allows the user to deposit a desired amount of sand therein, commensurate with the desired pressure to be exerted by roller body 12. The user then securely replaces cap member 26 on container member 24, and secures roller member 12 within U-shaped frame 16 with bolts 20.

Figure 3:
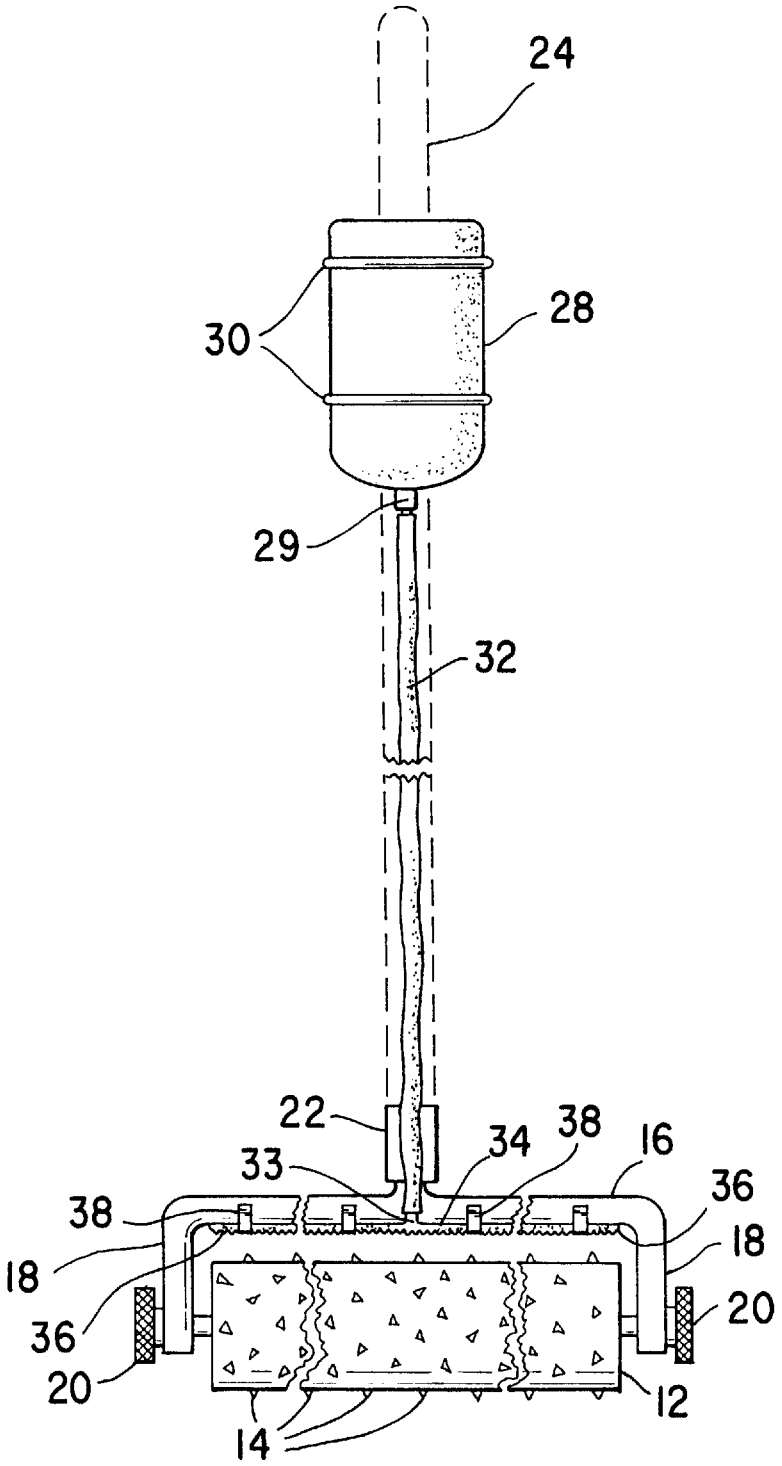
FIG. 3 is a front elevational view of the rolling tool for concrete finishing of the present invention, with the detachable irrigation system secured in place.

The roller tool of the present invention further comprises a roller irrigation system, as illustrated in FIG. 3. The roller irrigation system helps to prevent the accumulation of concrete debris on roller body 12. A pair of clamps 30 secure a water bottle 28 to handle 24. A hose 32 is secured to handle 24 at a point below bottle 28, whereby hose 32 connects the opening 29 of bottle 28 to the inlet valve 33 of an irrigation member 34. Irrigation member 34 terminates in a plurality of conduits 36. A plurality of clamps 38 detachably secures irrigation member 34 onto the front side of U-shaped frame 16. Water stored in bottle 28 flows through hose 32 and conduits 36 to continuously moisten roller body 12, and thereby prevent the accumulation of concrete debris thereon.

In one embodiment of the roller irrigation system, gravity controls the gradual water flow from bottle 28 through hose 32 and into conduits 36. An alternative embodiment of the roller irrigation system of the present invention incorporates a hand-controlled water release, such a finger trigger that actuates water flow from bottle 28 through hose 32 and into conduits 36.

Figure 4:
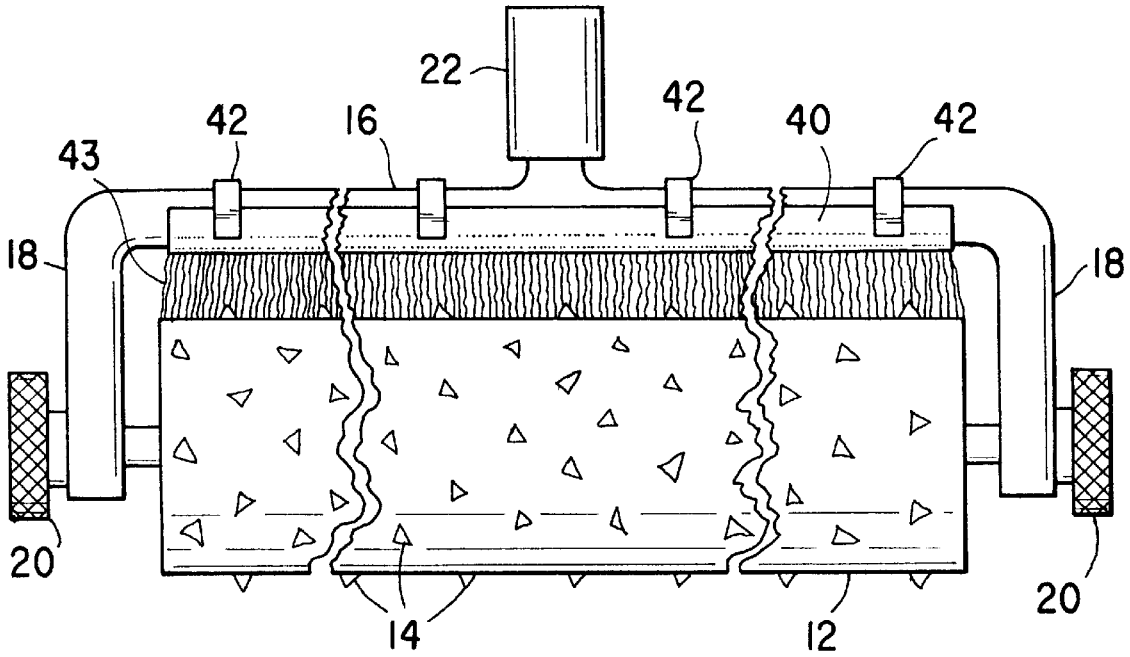
FIG. 4 is a back elevational view of the rolling tool for concrete finishing of the present invention, with the broom attachment secured in place.

Further means for keeping roller body 12 clear from concrete debris comprise a broom attachment 40, as shown in FIG. 4. A plurality of clamps 42 detachably secure broom 40 onto the back side of U-shaped frame 16, as shown in FIG. 4. The bristles 43 of broom 40 contact the surface of roller body 16, so that rotational motion of roller body 16 facilitates the brushing off of concrete debris that accumulates thereon.

Figure 5:
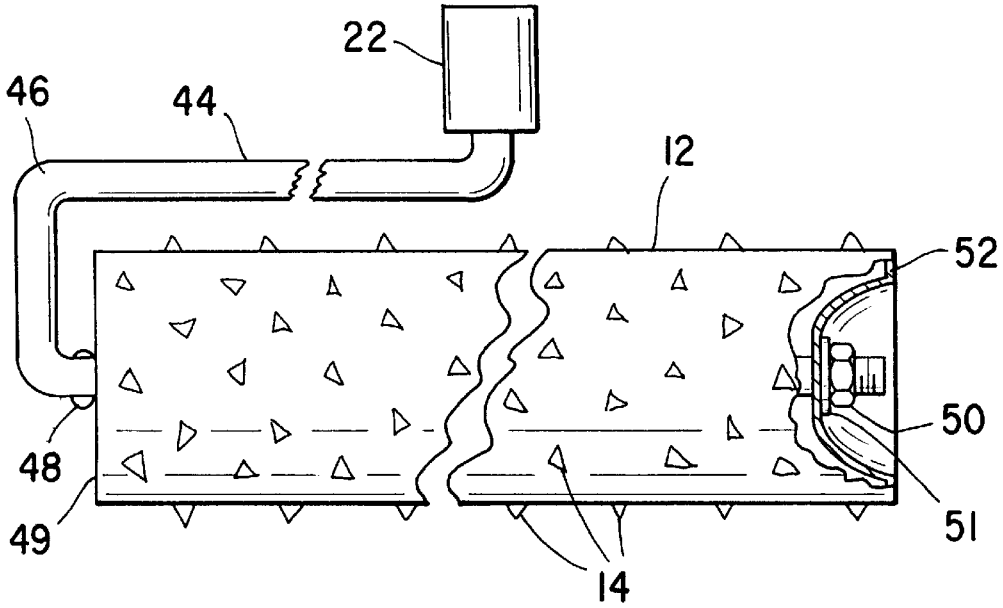
FIG. 5 is a front elevational view of another alternative embodiment of the rolling tool for concrete finishing of the present invention.

Now referring to FIG. 5, another alternative embodiment of the present invention comprises a one-sided axle support system for roller body 12. A substantially cylindrical member 44 extends from socket member 22, and curves so as to form a 90 degree angle therewith. Another substantially cylindrical member 46 integrally connects to the end of member 44 farthest from socket member 22, perpendicular thereto and in the opposite direction of socket member 22. A third substantially cylindrical member 48 integrally connects to the end of member 46 farthest from the interface with member 44, perpendicular thereto and substantially parallel to member 44. Member 48 insertably engages an aperture defined by the circular end surface 49, in the substantial center thereof, and extends along the interior of roller body 12 to the other side. FIG. 5 illustrates one way to secure roller body 12 onto member 48, where the end of member 48 farthest from the interface with member 46 is threaded to receive a nut 50 and a washer 51. The end of roller body 12 farthest from member 46 is open to receive a substantially hemispherical insert 52, which engages the end of cylindrical member 48, and facilitates the unobtrusive placement of nut 50 and washer 51 within roller body 12. This embodiment of the invention affords its use on the side edges of concrete surfaces, which are not accessible by other embodiments of the invention, thereby guaranteeing a complete concrete pattern finish.

It is to be understood that the present invention is not limited to the embodiments described above, but encompasses any and all embodiments within the scope of the following claims.

We claim:

1. A concrete-finishing roller tool comprising:

a substantially cylindrical hollow roller body having a length and an interior, said roller body comprising two opposingly disposed circular end surfaces and an endless surface, said circular end surfaces each defining an aperture in the center thereof, and said endless surface incorporating randomly spaced protrusions thereon;

a substantially U-shaped frame, said frame terminating in two end flanges, said end flanges rotatably engaging said circular end surfaces of said roller body and said flanges each defining an flange aperture, the flange apertures proximate to said apertures defined by said circular end surfaces;

means for removably securing said end flanges to said circular end surfaces of said roller body;

a female socket member, said socket member integrally connected to said U-shaped frame at the center thereof, on the side opposite to said roller body, whereby said socket member receives a separate pole handle to facilitate the remote manipulation of said roller body; and concrete filler evenly distributed along the length of the interior of said roller body to ensure the exertion of a constant pressure to facilitate an even texturing pattern on a concrete surface.

2. The concrete-finishing roller tool according to claim 1, wherein said means for removably securing said end flanges to said circular end surfaces of said roller body comprises a pair of bolts, each of said bolts insertably engaging said apertures defined by each of said flanges and said apertures defined by each of said circular end surfaces of roller body.

3. The concrete-finishing roller tool according to claim 1, wherein said randomly spaced protrusions have a substantially crystalline structure to emulate grains of salt for use in texturing freshly-poured concrete.

4. The concrete-finishing roller tool according to claim 1, wherein said roller body further comprises a substantially cylindrical container member and a cap member, said cap member threadably engaging said container member, whereby removal of said roller body from said U-shaped frame allows a user to disengage said cap member from said container member so as to deposit an amount of sand therein, commensurate with a desired pressure to be exerted by said roller body on a concrete surface, and to securely replace said cap member on said container member and replace said roller member within U-shaped frame.

5. The concrete-finishing roller tool according to claim 1, further comprising a roller irrigation system, said roller irrigation system comprising:

an enclosed water reservoir, said reservoir comprising an opening and means for detachably securing it to a pole handle;

an irrigation member, said irrigation member comprising an inlet valve, a plurality of conduits and means for detachably securing said irrigation member to said U-shaped frame, and;

a hose, said operably connecting said reservoir opening to said irrigation member inlet valve, whereby water stored within said reservoir flows through said hose to said irrigation member and through said conduits to continuously moisten said roller body and thereby prevent the accumulation of concrete debris thereon.

6. The concrete-finishing roller tool according to claim 5 wherein said roller irrigation system further comprises gravitational drip means for controlling the water flow from said reservoir.

7. The concrete-finishing roller tool according to claim 5 wherein said roller irrigation system further comprises manually-controlled means for actuating water flow from said reservoir.

8. The concrete-finishing roller tool according to claim 7 wherein said manually-controlled means for actuating water flow from said reservoir comprises a finger trigger.

9. A concrete-finishing roller tool comprising:

a substantially cylindrical hollow roller body, said roller body comprising two opposingly disposed circular end surfaces and an endless surface, said circular end surfaces each defining an aperture in the center thereof, and said endless surface incorporating randomly spaced protrusions thereon;

a substantially U-shaped frame, said frame terminating in two end flanges, said end flanges rotatably engaging said circular end surfaces of said roller body and said flanges each defining an flange aperture, the flange apertures proximate to said apertures defined by said circular end surfaces;

means for removably securing said end flanges to said circular end surfaces of said roller body;

a female socket member, said socket member integrally connected to said U-shaped frame at the center thereof, on the side opposite to said roller body, whereby said socket member receives a separate pole handle to facilitate the remote manipulation of said roller body; and detachable means for clearing dried concrete debris from said endless surface of said roller body.

10. The concrete-finishing roller tool according to claim 9 wherein said detachable means for clearing concrete debris from said surface of said roller body comprise a broom member, said broom member comprising means for removably securing said broom member to said U-shaped frame, and a plurality of bristles, said bristles contacting said endless surface of said roller body.

11. A concrete-finishing roller tool comprising:

a substantially cylindrical hollow roller body, said roller body comprising an endless surface and a substantially circular end surface, said endless surface incorporating randomly spaced protrusions thereon, said circular end surface engaging one side of said endless surface and said circular end surface defining an aperture in the substantial center thereof;

a one-sided axle support system for said roller body, said axle support system comprising first, second and third integrally connected, substantially cylindrical members, said first member having a threaded free end, said first member insertably engaging said aperture defined by said circular end surface and being removably secured within said roller body to facilitate rotational movement thereof, said second cylindrical member oriented perpendicularly to said first cylindrical member and disposed at one end thereof, and said third cylindrical member oriented perpendicularly to said second cylindrical member and disposed at one end thereof, so as to be parallel to said first cylindrical member;

unobtrusive means for removably securing said first cylindrical member within said roller body, and;

a female socket member, said socket member integrally connected to an upturned end of said third cylindrical member so as to be oriented perpendicularly to said roller body at a point proximate to the substantial center thereof, whereby said socket member receives a separate pole handle to facilitate the remote manipulation of said roller body.

12. The concrete-finishing roller tool according to claim 11 wherein said unobtrusive means for removably securing said first cylindrical member within said roller body comprise a substantially hemispherical insert, a washer and a nut, the threaded free end of said first cylindrical member insertably engaging, in sequence, said insert, said washer and said nut, so that said insert facilitates the unobtrusive placement of said washer and said nut within said roller body.

* * * * *